United States Patent [19]

Thomas

[11] Patent Number: 4,812,111

[45] Date of Patent: Mar. 14, 1989

[54] VARIABLE DISPLACEMENT ROTARY FLUID MACHINE

[76] Inventor: Cyril J. A. Thomas, 49 Central Ave., Pinner, Middlesex, Great Britain, HA5 5BT

[21] Appl. No.: 198,701

[22] Filed: May 17, 1988

Related U.S. Application Data

[63] Continuation of Ser. No. 894,686, Aug. 8, 1986, abandoned.

[30] Foreign Application Priority Data

Aug. 9, 1985 [GB] United Kingdom ..... 8520097

[51] Int. Cl.[4] ..... F01C 1/10; F01C 21/16

[52] U.S. Cl. ..... 418/20; 418/21; 418/24; 418/28

[58] Field of Search ..... 418/21, 28, 16, 19, 418/20, 21, 24, 28, 29, 210, 212, 213

[56] References Cited

U.S. PATENT DOCUMENTS

| | | | |
|---|---|---|---|
| 1,486,682 | 3/1924 | Phillips | 418/28 X |
| 1,486,836 | 3/1924 | Hill | 418/19 X |
| 1,990,750 | 2/1935 | Pigott | 418/21 |
| 2,484,789 | 10/1949 | Hill et al. | 418/21 |
| 2,561,890 | 7/1951 | Stoddard | 418/16 |
| 2,840,991 | 7/1958 | Nisbet | 418/28 |
| 2,909,033 | 10/1959 | Hill | 418/28 X |
| 3,805,526 | 4/1974 | Charron | 418/21 X |
| 4,008,982 | 2/1977 | Traut | 418/28 X |
| 4,188,176 | 2/1980 | Traut | 418/28 X |

FOREIGN PATENT DOCUMENTS

| | | | |
|---|---|---|---|
| 375986 | 5/1921 | Fed. Rep. of Germany | 418/21 |
| 862094 | 1/1953 | Fed. Rep. of Germany | 418/21 |
| 859793 | 11/1961 | United Kingdom | 418/21 |

*Primary Examiner*—Carlton R. Croyle
*Assistant Examiner*—Leonard P. Walnoha

[57] ABSTRACT

An internally meshing gear-pump, or motor comprises inlet and outlet ports 27,28 for the working fluid through a sealing plate 5 mounted on the shaft 1, an externally-toothed gear 2 is longitudinally displaceable relative to internally-toothed gears 3,4 to vary the pump or motor displacement, a sealing member 6 is secured to the end-face of the gear 2 which separates the displacement chambers 29,30 from the varying volume spaces which may be filled by controlled working fluid formed in both longitudinal and diametrically opposite regions 11,12. When the gear 2 is moved longitudinally from the maximum displacement position to the extreme left to a reduced capacity position and thus varies the output of the pump or motor mounting these machines back-to-back or in other combinations, a continuously variable and or differential transmission of working fluid may be obtained. Additionally electrical windings 85,86 may be mounted in the casings 7,8.

7 Claims, 6 Drawing Sheets

VARIABLE DISPLACEMENT ROTARY FLUID MACHINE

This is a continuation of co-pending application Ser. No. 894,686 filed on Aug. 8, 1986, now abandoned.

The present invention relates to a variable displacement fluid machine.

The invention is particularly concerned with a variable displacement fluid machine in which a working fluid is passed through displacement chambers which are defined by lobed wheels.

The machines of the invention are an appropriate replacement for belt, chain and gear transmissions. The machines are also suitable in pump and motor combinations for vehicle steering and guidance systems, and for hydrostatic or volumetric gear pumps or motors.

In previously proposed fluid machines difficulties can arise in varying and controlling the operational capacity of the machines.

It is an aim of the invention to alleviate these difficulties, and according to the present invention there is provided a variable displacement fluid machine comprising an externally lobed first wheel mounted on a drive shaft for rotation in a casing, an internally lobed second wheel surrounding at least part of the first wheel and adapted to be rotated by said first wheel, the shaping and numbering of the lobes being such as to define displacement chambers between the two wheels which progressively decrease and increase in volume on rotation of the wheels, a third wheel located longitudinally from said second wheel and making a sliding fit on the first wheel, one end of said third wheel being adjacent to one end of said second wheel, and means to move the first wheel longitudinally to vary the capacity of the displacement chambers.

One embodiment of the invention will now be described by way of an example with references to the accompanying drawing in which.

Figure 1:
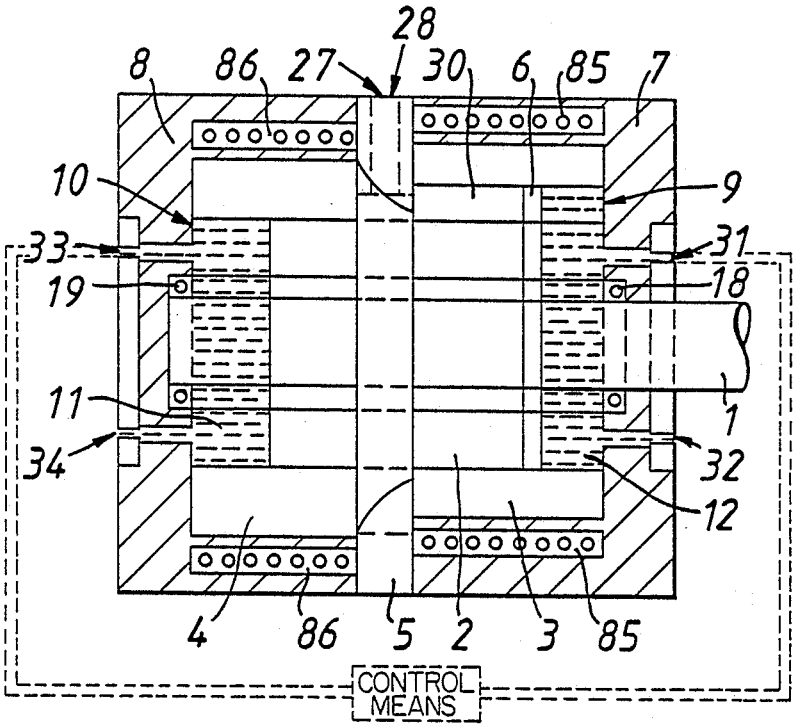
FIG. 1 is a side elevation in section of one rotary positive displacement fluid machine of the invention adjusted to give, or allow reduced flow.
Figure 7:
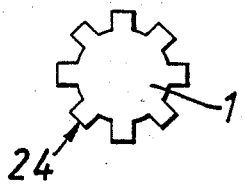
FIG. 7 is a front view of the rotor drive or driven shaft of the machine of FIG. 1.
Figure 4:
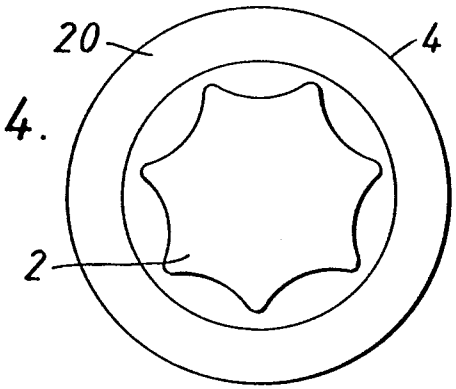
FIG. 4 is a front view of an outer complementary rotor and inner rotor of the machine of FIG. 1.
Figure 3:
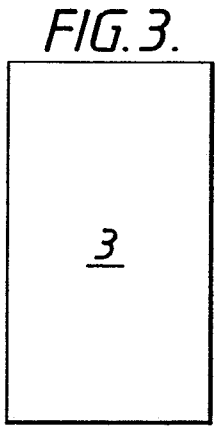
FIG. 3 is a side view of the outer control rotor of FIG. 2.
Figure 6:
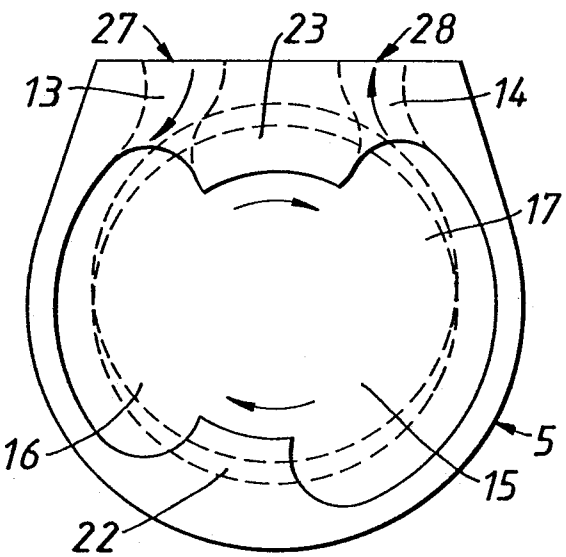
FIG. 6 is a front view of the distributor or collector plate of the machine of FIG. 1.
Figure 2:
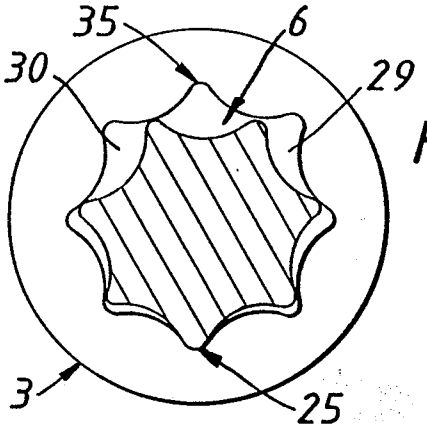
FIG. 2 is a front view of an outer control rotor and seal of the machine of FIG. 1.
Figure 5:
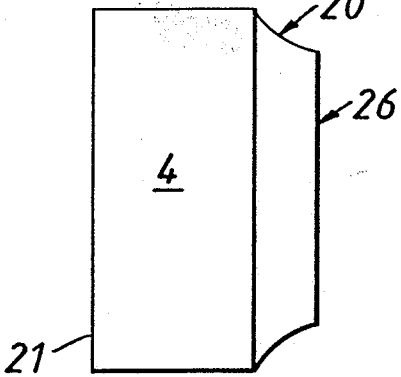
FIG. 5 is a side view of the outer complementary rotor of FIG. 4.

In this example the lobe type of pump or motor will be described.

The machine comprises of an inner rotor 2 and an outer control rotor 3, in which the inner rotor 2 is longitudinally displaceable relative to the outer control rotor 3, both rotors being rotatably mounted in a casing 7. The machine may also include an outer complementary rotor 4 rotatably mounted and located on the same centre as the inner rotor and dimensional to make it a sliding contact into which the inner rotor 2 may mesh. within the casing 8.

The machine may also include a fluid distributor, or collector plate 5, through the centre of which the inner rotor 2 may pass as part of the variable displacement pumping or motor action. The distributor plate is located between and adjacent to the outer control rotor 3 and the outer complementary rotor 4.

The pump or motor displacement chambers may be separated from the rotor end chambers 11, 12 by a single or multi-centred seal 6.

The pump or motor displacement chamber capacity may be varied by the longitudinal displacement of the inner rotor 2. The maximum capacity is obtained when the inner rotor 2 has maximum engagement with the outer control rotor 3 and minimum capacity when there is a minimum engagement with the outer control rotor 3. The machine may be used singularly or in combinations of two or more pumps and motors. When used in combinations of two or more a differential working fluid or gas flow may be distributed or collected to the combination. This differential flow may be controlled by the longitudinal positions of the inner rotors 2 of one or more of the pumps and motors. These different longitudinal positions regulate the size of the displacement chambers which control the rotational speed of the machines.

Around the circumference of the rotors 3 and 4 are electrical windings 85 & 86 constructed to form an electrical motor or generator or alterntor function. This function may be used to assist or retard the flow of working fluid through the machine of the invention of FIG. 1.

In the motor a similar process is used to control the speed of rotation of the driven shaft 1.

For a given rate of flow of working fluid the speed of the driven shaft can be varied by changing the size of the displacement chambers. To increase the rotational speed, the displacement chambers are decreased in size and to decrease the rotational speed the displacement chambers are increased in size. These displacement chamber size changes are made in the same manner as for the pump.

An electrical current flows through the electrical windings 85 and 86. The winding surrounds the two rotors 3 and 4.

As the rotors rotate there is a change of flux within the windings due to the lobes of the rotors. This change of flux will produce a change in the current flow. The change in current flow may be controlled such that it may accelerate or retard the speed of rotation of the machine dependent upon the control applied.

DESCRIPTION OF UNITS—DRIVE SHAFT

The drive shaft 1 may be the rotational drive or driven primary member of the invention. Its function depends upon the use to which the invention is put, either in the action of a drive shaft in a pump or a driven shaft in a motor. The shaft is located so as to pass through the centre of the inner rotor 2 for the transmission of the rotational drive.

The shaft is mounted within the casings 7, 8 and at either or both ends of the shaft, where it enters the casing, the shaft may be supported by a bearing. The shaft may emerge from either or both ends of the casing, where attachment to other mechanism or prime movers may be made.

The splines 24 on the drive shaft 1 are keyed on the same centre as the inner rotor 2 and extend for the length dimensioned by the inner opposite surfaces 9, 10 of the casings 7, 8.

The number and dimensions of the splines or keys 24 are dependent upon the inventions application in its use or working environment.

The drive shaft 1 may be of solid or hollow construction.

Where the shaft is in contact with the casing 7, 8 seals may be attached to the shaft or casing or both to prevent working fluid or gaseous migration or leakage from the inner rotor end chambers 11 and 12 along the drive shaft 1 to the outside of the invention.

DESCRIPTION OF UNITS—INNER ROTOR AND DISPLACEMENT CHAMBER SEAL

The inner rotor 2 in conjunction with the outer control rotor 3 provide the displacement chambers 29, 30 for the pump, or motor.

The inner rotor 2 is mounted through its centre upon the drive shaft 1 by means of a splined hole on the same centre and having the same radius as thee drive shaft 1, but with sufficient clearance to allow sliding movement along the splined length of the drive shaft 1.

The amount of longitudinal engagement between the inner rotor 2 and the outer control rotor 3 dimensions the size of the displacement chambers 29, 30. The inner rotor 2 is a rotatable, externally toothed gear mounted upon the drive shaft 1. It is longtitudinal displaceable upon the drive shaft 1, and is in continuous sliding contact with the outer control rotor 3 and outer complementary rotor 4.

The inner rotor 2 is in mesh with the control rotor 3 at one point on its circumference, it is in total mesh with the complementary rotor 4 about the inner rotor's whole external circumference.

The inner rotor 2 is confined within the casings 7, 8 and may move longtitudinally as far as the surfaces 9, 10 of the casings 7, 8 by means of the working fluid being introduced into the end chambers 11, 12.

Attached to the control rotor end of the inner rotor is the multi-centred seal 6, this seal is to separate the displacement chambers 29, 30 from the inner rotor control end chamber 22. This may be constructed in three sections. The outer section fits against the internal toothed surface of the control rotor 3. The inner section fits against the end surface of the inner rotor 2.

The number of lobes and other dimensions of the inner rotor 2 are dependent upon the inventions application or in its use or working environment.

DESCRIPTION OF UNITS—OUTER CONTROL ROTOR

The outer control rotor 3 together with the inner rotor 2 provide the displacement chambers of the machine.

The outer control rotor 3 is an internally toothed gear being rotatably driven by the rotation of the inner rotor 2. It has a smooth external circumference and smooth end faces with sufficient clearance to allow rotation but with no significant longtitudinal movement. The outer control rotor 3 is mounted within the control rotor casing 7.

The outer control rotor 3 mochoo with the inner rotor 2 at only one point on its internal circumference. The mounting of the outer control rotor 3 is such that its center line is displaced from that of the drive shaft 1. This displacement is designed to ensure that at 180 degrees from the point of meshing with the inner rotor 2, the extremities of the teeth of the inner 2 and outer 3 control rotors will be in close sliding contact with each other.

This condition produces two separate displacement chambers 29, 30, one which is progressively increasing as the two rotors 2, 3 rotates, starting from the meshing point 25, until a maximum volume is reached 180 degrees later at the displacement chamber separation point 35. After separation point 35 is reached and as rotation continues the chambers get progressively smaller until a zero volume is reached at the meshing point 25.

Where the chambers are increasing in size there is a suction effect on the working fluid, and where the chambers are decreasing a continuous pressurized flow of working fluid or gas is produced.

The number of teeth in the ring gear will be dependent upon the environment in which the rotor 3 will operate. The size of the unit is likewise influenced by its working applications.

DESCRIPTION OF UNITS—OUTER COMPLEMENTARY ROTOR

The outer complementary rotor 4 provides the distributor plate seal 20 for the pump or motor displacement chambers 29 and 30. It also assists in the longitudinal control and stability for the inner rotor 2.

Referring to FIG. 1 it can be seen that the rotor 4 is mounted within the complementary rotor casing 8 where it may fully mesh with the inner rotor 2 about its entire internal circumference.

The outer complementary rotor 4 is an internally toothed gear being rotatably driven by the rotation of the inner rotor 2 and is mounted on the same centre as the inner rotor 2. The rotor 4 is held in its position by a combination of the casing 8 and the distributor plate 5. It may have a smooth external circumference with sufficient clearnances to allow rotation but with no significant longtitudinal movement.

The end surface 21 opposite the distributor plate 5 may be smooth. The surface 26 adjacent to the distributor plate 5 may be flat and smooth but with a curved section removed from the junction of the circumference and the distributor plate end surface 26. The removed section is taken from the entire circumference. This surface 20 of the outer complementary rotor 4 will be in close sliding contact with the two complementary shaped sections 22, 23, in the distributor plate 5 used to seal the displacement chamber 29 from 30.

The size and number of teeth in the rotor will depend upon the working application and environment.

DESCRIPTION OF UNITS—DISTRIBUTOR PLATE

The distributor plate 5 delivers and collects the working fluid or gas to the pump, or motor and it also forms part of the displacement chamber seal. The centre section 15 is removed, on the same centre and the same radius as the inner rotor 2 this removed section allows the passage of the inner rotor 2 through the distributor plate's central section. The distributor plate 5 is positioned between the outer control rotor 3 plus its casing 7 and the outer complementary rotor 4 plus its casing 8.

The surface 20 of the outer complementary rotor 4 is in rotating sliding contact with the distributor plate meshing point sealing section 22 and distributor plate feed channels sealing section 23.

The two sections 22, 23 shaped to match and in sliding contact with the complementary rotor distributor plate sealing surface 20 isolate the suction side from the pressure side of the pump, or motor displacement chambers 29 and 30.

The distributor plate 5 has integral chambers 16, 17 to guide and direct the flow of working fluid or gas to and from the pump, or motor displacement chambers 29 and 30. The integral or internal chambers 16, 17 are also connected by channels 13 or 14 to the inlet and outlet ports 27, 28 of the pump or motor.

The distributor plate 5 may be an integral part of the casing or housing and may be used to mount or secure the casings.

DESCRIPTION OF UNITS—END CHAMBERS

The inner rotor control and complementary end chambers 11, 12 contain the working fluid which controls the longtitudinal position of the inner rotor 2 upon the drive shaft 1.

These chambers 11, 12 are connected to the ports 31, 32, 33 and 34, though which the working fluid may be forced against or drawn from the axial extremity of the inner rotor 2.

In FIG. 1 the inner rotor 2 is shown midway along the drive shaft 1, both chambers 11, 12 are partly filled thus the displacement chambers 29, 30 are set to less than their maximum capacity. As the three rotors 2, 3 and 4 and the drive shaft 1 rotate, so the working fluid within the chambers 11, 12 will, by sympathetic action, also rotate.

So that the working fluid may easily enter and exit from the chambers 11, and 12 one or more ports are provided to each chamber and may be set diagonally (not shown) to assist the flow of working fluid, these ports are located in the casings 7, and 8.

By controlling a proportion of the suction or pressurized flow of working fluid a change in the volume of working fluid in the chambers 11, 12 can be made, this will alter the longtitudinal position of the inner rotor 2.

Figure 8:
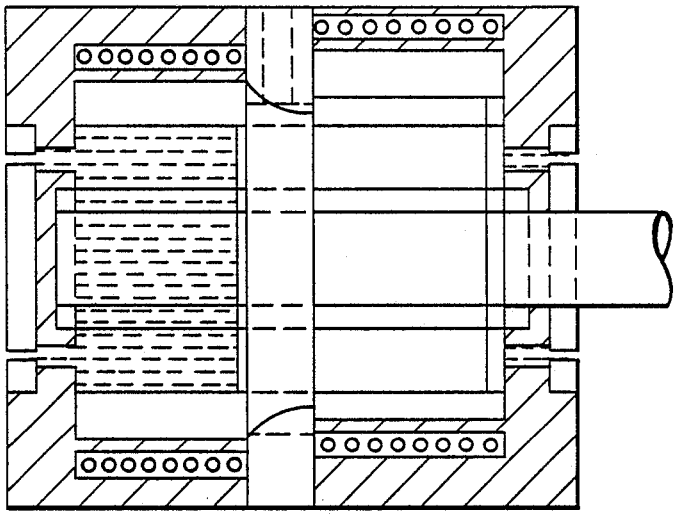
FIG. 8 shows a section through the machine of FIG. 1. adjusted to give or allow maximum flow.

Thus if the working fluid is removed from chamber 12 by suction, and increased in chamber 11 by pressurized flow in equal and opposite proportion there will be a longtitudinal change to the right as shown in FIG. 8, this will consequentially increase the size of the displacement chambers 29, 30.

Figure 9:
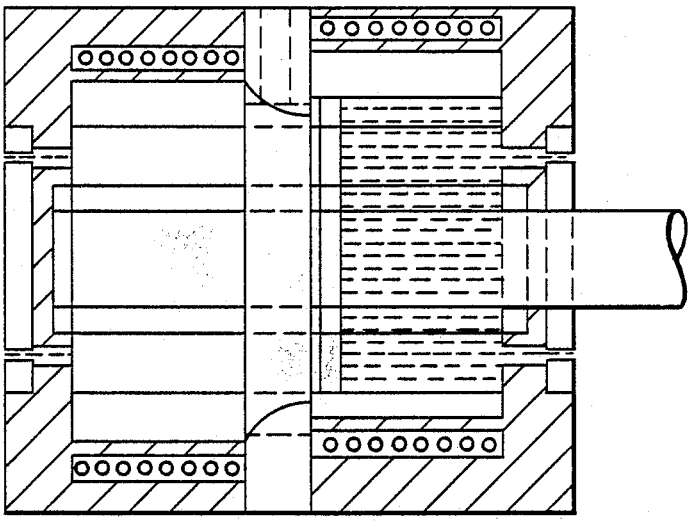
FIG. 9 Shows a section through the machine of FIG. 1. adjusted to give or allow minimum flow.

Conversely if working fluid is increased in chamber 12 by pressurized flow and removed from chamber 11 by suction then the size of the displacement chamber is reduced to a minimum as shown in FIG. 9.

APPLICATION OF THE INVENTION BY COMBINATIONS TO PROVIDE A CONTINUOUSLY VARIABLE (AUTOMATIC) TRANSMISSION

In this first example a variable displacement pump and motor may be substituted for the current means of transmission in a vehicle or vessel.

By mounting a combination of pump and motor, back to back, of approximatly equal dimensions and whose inner rotors 2 are at opposite ends of their respective drive/driven shafts 1 a continuously variable rotational output of speed, torque and power from the motor may be obtained from a fixed input of torque to the pump. This change in the output is obtained by changing the relative longtitudinal positions of both of the inner rotors 2.

Figure 10:
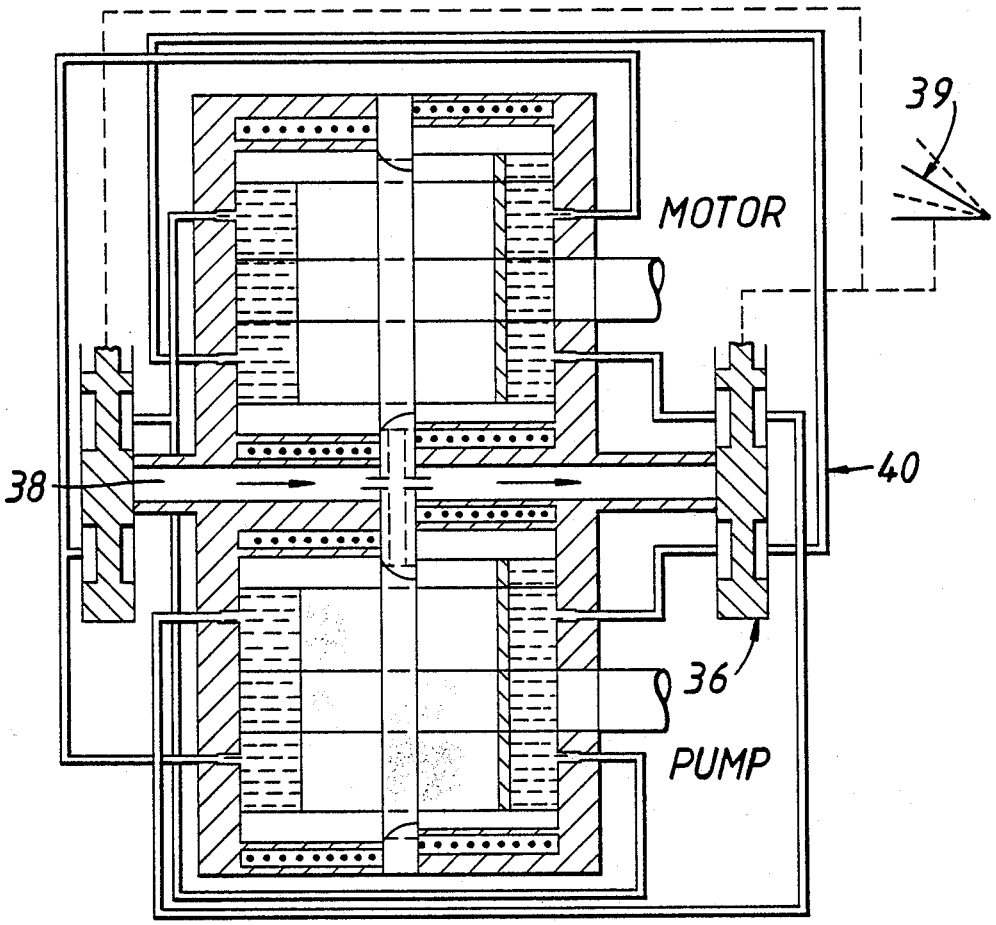
FIG. 10 is a side view of the machine of FIG. 1. in combinations to provide a Continuously-Variable (Automatic) Transmission.

Referring to FIG. 10 the figure shows the pump at the bottom and the motor at the top of the combination. The ports 31, 32, 33 and 34 are connected by tubing to a spool valve 36.

The spool valve is shown in two parts. On the left of the figure the suction portion, on the right the pressurised flow portion. The spool valve is operated by a lever (accelerator), shown in a partly operated position.

When the lever is moving down both portions of the valve move down in the cylinder such that a channel is opened between the suction and pressurised flow lines 37 and 38, the valve annular grooves and the tubing leading to theentry and exit ports 31, 32, 33 and 34 of the pump and motor. This action removes working fluid from chamber 12 in the pump and chamber 11 in the motor by suction. By pressurised flow working fluid is forced into chamber 11 in the pump and chamber 12 in the motor. This action increases the speed of rotation of the motor shaft 1 until the rotor completes its travel along the shaft 1.

While the lever is being raised the opposite action takes place, the valve is moved up and the lower annualar grooves provide the channels for the working fluid flow. The pump chamber 12 decreases in size and the motor chamber 12 increases in size, thus the output shaft speed of the motor decreases.

Thus the pump may start with its inner rotor 2 having maximum engagement with its complementary rotor 4 giving a minimum size of displacement chamber 29, 30 and progressively sliding along the drive shaft 1 increasing the displacement chambers 29, 30 to their maximum size. The motor at the same time, whose inner rotor 2 is at the opposite end of its drive shaft 1 also slides along its drive shaft progressively decreasing the displacement chambers 29, 30 to their minimum size.

The effect of this process on the rotational speed of the output motor shaft is to smoothly increase the speed until its maximum is reached. Conversely if the pump displacement chambers 29, 30 are reduced from their maximum towards their minimum size and the motor performs the oppsite action, then the output speed will be smoothly decreased.

APPLICATION OF THE INVENTION BY COMBINATIONS TO PROVIDE A CONTINUOUSLY VARIABLE (AUTOMATIC) STEERABLE TRANSMISSION

In this example a variable-displacement pump and motors may be substituted for the current means of transmission in a vehicle or vessel, this pump and motors combination may be so arranged so as to provide a continuously variable (automatic) differentially steerable trasmission.

Where this combination includes two or more motors which may be equally dimensioned, and a pump. The output of working fluid from the pump member may be divided between the motors. This division of the working fluid may be under the control of a directional mechanism which controls the position of the inner rotor 2 of each motor relative to the other by controlling the proportion of working fluid flowing through each motor.

When the displacement chamber sizes of the motors are unequal there will be a difference in the speed of rotation of the motor shafts. This difference in the speed of rotation may be used to control the direction of the vehicle.

Figure 11:
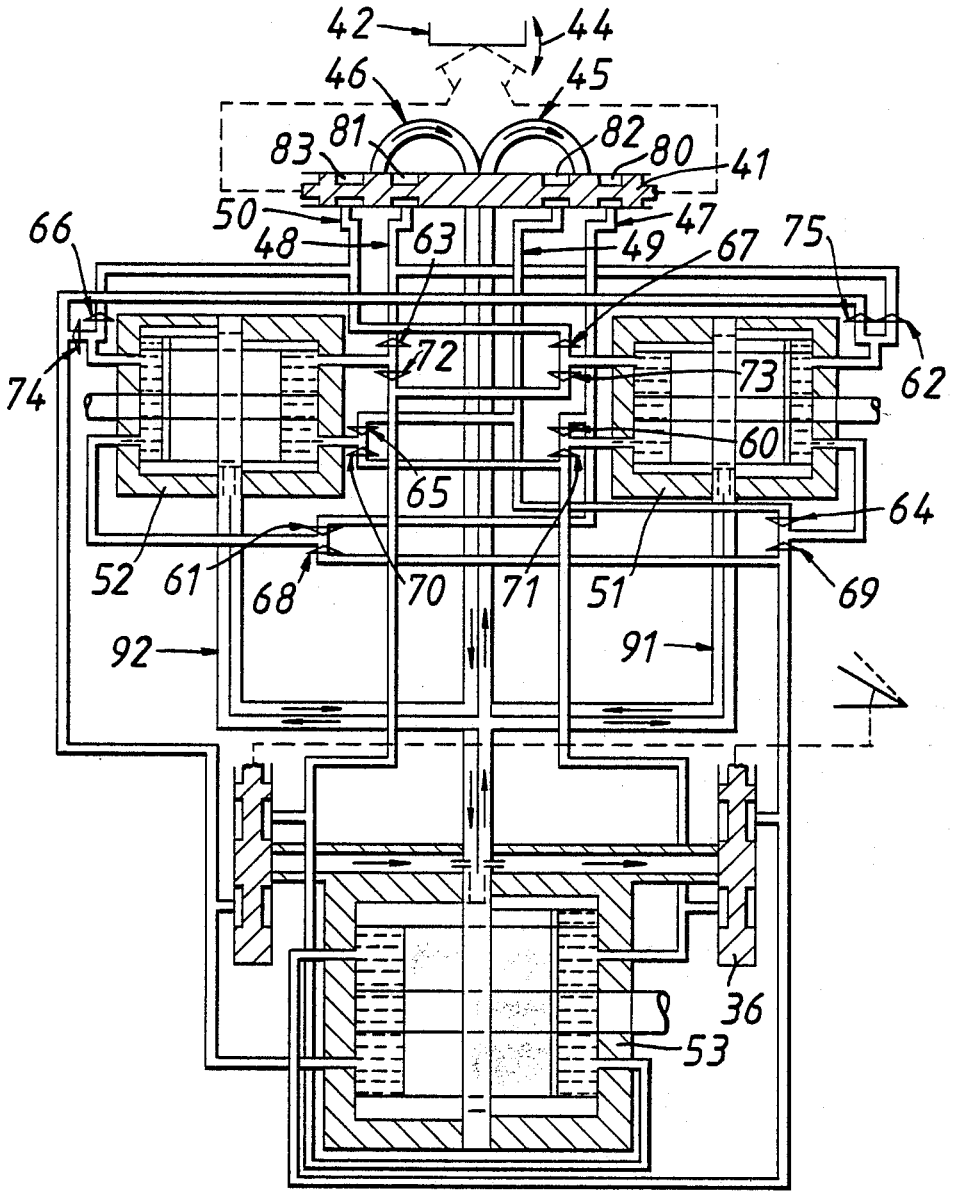
FIG. 11 is a side view of the machine of FIG. 1. in combinations to provide a Continuously-Variable (Automatic) Steerable Transmission.
Figure 12:
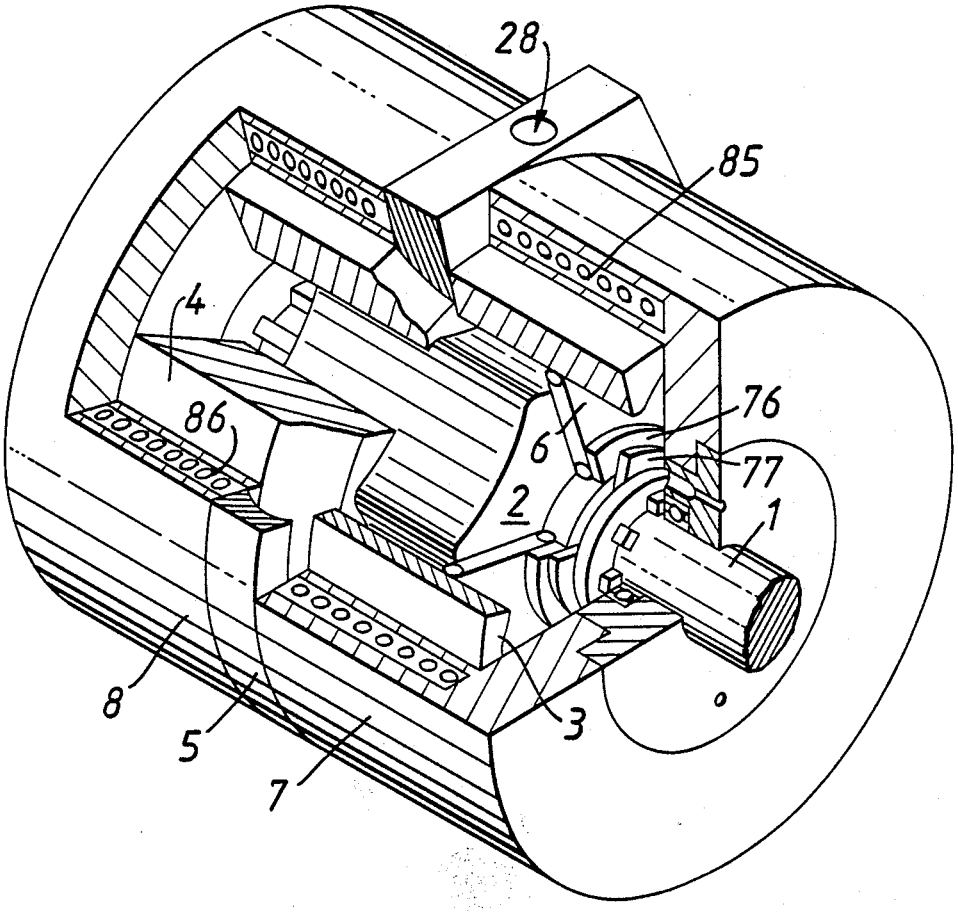
FIG. 12 shows an isometric projection of the machine of FIG. 1.

Refferring to FIG. 10 and also FIG. 11 it can be seen that the automatic transmission components of the invention is similar in many pariculars on both figures.

The end chambers 11 and 12 of the motors are connected to two sources of working fluid which control the position of the inner rotors 2.

1. From the motion control spool valve 36.
2. The direction control spool valve 42.

Each control source is provided via flow check valves 60 to 75 to every port of each motor, sixteen are shown on FIG. 11. At the point that working fluid enters the motors 51 and 52 entry and exit ports the sixteen check valves are located. These ports numbered 60 to 67 prevent working fluid from entering the direction control system from the motion control system. Conversly the ports 68 to 75 prevent working fluid from entering the motion control system fromthe direction control system. The direction of flow is indicated by the direction of the apex of the triangle within the tubing in which it is located.

Thus the two systems, direction control and motion control are separated and can not influence each other, but are able to work in combination on the motors, to control the longtitudinal positions of the inner rotors 2 which in turn controls the relative speed of rotation of the motors shafts 1. Where two motors are operated as shown in FIG. 11 and are mounted in a vehicle, with the motor shafts 1 connected to road wheels, the differential speed of the motors as controlled by the lever mechanism 42 and may be used to control the direction of the vehicle in motion.

The lever mechanism 42 can operate though the angle 44. This movement is transferred to the end surfaces of the direction control spool valve 41 while the movement is taking place working fluid from the pump 53 suction and pressurised, is supplied to the valve 41 where, when the lever 42 is operated right hand down the valve mechanism 41 moves to the left, the annular channels 80 is positioned under the pressurised flow pipe 45. Working fluid flows down the pipe 47 to the check valves 60 and 61 through the valves and into the end chamber 11 of the R.H. motor 51 and into the end chamber 12 of the L.H. motor 52, simultaneously the annular channel 81 is positioned under the suction flow pipe 46 and fluid is drawn though the check valves 62 and 63 from the end chamber 12 of the R.H. motor 51 and from the end chamber 11 of the L.H. motor 52.

This action increases the size of the displacement chambers 29 and 30 in the R.H. motor 51 and decreases the size of the displacement chambers 29 and 30 in the L.H. motor 52. Thus for a constant flow of working fluid through the pipes 91 and 92 the increase size of the displacement chamber will reduce the speed of rotation of the R.H. motor 51 and the decreased size of the displacement chambers will increase the speed of rotation of the L.H. motor 52. Thus the L.H. motor 52 will run faster than the R.H. motor 51.

Conversly when the lever 41 is operated left hand down, while the movement is taking place the valve 41 moves to the right. The annular channels 82 is positioned under the pressurised flow pipe 45. Working fluid from the pump 53 flows down the pipe 49 to the check valve 64 and into the end chambers 12 of the R.H. motor 51, also working fluid flows via the pipe 49 and check valve 65 into the end chamber 11 of the L.H. motor 52.

Simultaneously the annualar channel 83 is positioned under the suction flow pipe 46 working fluid to the pump 53 flows up from the pipe 50 via the check valve 66 from the end chamber 12 of the L.H. motor 52, also working fluid flows via the check valve 67 from the end chamber 11 of the R.H. motor 51.

This action increases the size of the displacement chambers 29 and 30 in the L.H. motor 52 and decreases the size of the displacement chambers 29 and 30 in the R.H. motor 51.

Thus for a given flow of working fluid from the pump 53 the shaft 1 in the L.H. motor 52 will rotate slower than the shaft 1 of the R.H. motor 51. When the above mechanism is attached as the transmission of a vehicle it may provide directional control for the vehicle.

DESCRIPTION OF UNITS—ELECTRICAL MODIFIER

Surrounding the circumference of the outer control rotor 3 and the outer complementary rotor 4, attached or within the casings 9 and 8 are the electrical windings 85 and 86. By their external connections (not shown) these windings together with the rotation of the rotors 3 and 4 may form an electrical motor or generator or alternator mechanism. This mechanism may be used to modify the operation by assisting or retarding the rotation of the rotors of the machine of the invention in FIG. 1.

An alternative function of thes windings may be as part of a sensor or sensors to detect movement of the rotors, their speed of rotation and or their direction.

I claim:

1. A variable displacement fluid machine comprising: an externally lobed first wheel mounted for rotation in a casing and at least partially received within an internally lobed second wheel eccentrically mounted with respect to said first wheel for rotation in said casing, the lobes of said first wheel engaging the lobes of said second wheel so that rotation of one of said wheels induces rotation of the other of said wheels and forms displacement chambers which progressively decrease and increase in volume on rotation of said wheels, a third wheel mounted for rotation in said casing and longitudinally adjacent said second wheel and concentric with said first wheel, said first wheel being longitudinally displaceably received into an axially extending passage in said third wheel, said passage being internally profiled to sealingly engage the lobed periphery of said first wheel and to close one end of said displacement chambers;

said casing having two radially inwardly directed and circumferentially spaced sealing sections which are disposed longitudinally between said second and third wheels;

the third wheel having a sealing surface which sealingly abuts said sealing sections and said third wheel sealingly abutting said second wheel radially inwardly of said sealing sections to form a nonrotatable outlet chamber and a nonrotatable inlet chamber which are sealed from each other and which are adjacent to and communicate with said displacement chambers, said outlet chamber communicating directly with displacement chambers which contract during rotation of said first and second wheels and said inlet chamber communicating directly with displacement chambers which expand during rotation of said first and second wheels;

a fluid inlet port in the casing which communicates with the inlet chamber and a fluid outlet port in the casing which communicates with the outlet chamber;

first and second control chambers provided in said casing and communicating with longitudinally opposed ends of the first wheel, said control chambers being subjected to variable fluid pressure by a control means to move said first wheel longitudinally, and a seal longitudinally slidably and sealingly engaging the lobed interior surfaces of said second wheel and sealingly engaging a second end of said first wheel received within said second wheel to close the end of each of said displacement chambers longitudinally remote from said inlet and outlet chambers whereby longitudinal displacement of said first wheel by varying the fluid pressure in the control chambers varies the capacity of the displacement chambers.

2. A fluid machine as claimed in claim 1 in which said control means includes a conduit systems to pass fluid between the first and second control chambers.

3. A fluid machine as claimed in claim 1 in which electric windings are disposed around said wheels to affect their rotation on application of an electric current to the windings.

4. A fluid machine as claimed in claim 1 in which electric windings are disposed around said wheels to monitor the operation of the machine.

5. A fluid machine as claimed in claim 2 in combination with a system in which one of said fluid machines acts as a pump to supply working fluid to another of said machines operating as a motor, the supply of said fluid being achieved by way of conduits and controlled by a valve.

6. A fluid machine as claimed in claim 5 in which the conduits connect the control chambers of a first fluid machine acting as a pump to the control chambers of a second fluid machine acting as a motor to enable fluid to flow from the control chambers of one fluid machine to the control chambers of the other fluid machine and said flow of fluid being controlled by a valve.

7. A machine as claimed in claim 6 in combination with a vehicle to provide a vehicle drive transmission and steering system comprising a first fluid machine acting as a pump to provide working fluid to at least two other fluid machines acting as motors and each coupled to separate driving means of the vehicle.

* * * * *